US006273534B1

(12) United States Patent
Bueley et al.

(10) Patent No.: US 6,273,534 B1
(45) Date of Patent: Aug. 14, 2001

(54) SHELVING ACCESSORY MOUNTING SYSTEM FOR A CABINET ASSEMBLY

(75) Inventors: Douglas J. Bueley, Petawawa (CA); James C. Muth, Oconomowoc, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 09/434,969

(22) Filed: Nov. 5, 1999

(51) Int. Cl.[7] ..... A47B 96/06

(52) U.S. Cl. ..... 312/334.8; 312/334.4; 211/187; 248/243

(58) Field of Search ..... 312/334.4, 334.5, 312/334.8, 350, 265.1, 265.4; 211/287; 248/220.43, 243

(56) References Cited

U.S. PATENT DOCUMENTS

| | | | | |
|---|---|---|---|---|
| Re. 28,994 | | 10/1976 | Aylworth . | |
| 2,733,972 | | 2/1956 | Diack . | |
| 3,572,874 | | 3/1971 | Hassel . | |
| 3,701,577 | | 10/1972 | Fischer . | |
| 3,905,712 | * | 9/1975 | McConnell | 248/243 X |
| 4,232,920 | | 11/1980 | Bukaitz . | |
| 4,553,725 | * | 11/1985 | Vargo | 211/187 X |
| 4,600,254 | | 7/1986 | Whalen . | |
| 4,712,844 | | 12/1987 | Fry . | |
| 4,955,672 | | 9/1990 | Pham . | |
| 5,163,568 | | 11/1992 | Laurendeau et al. . | |
| 5,333,949 | | 8/1994 | McGregor . | |
| 5,399,010 | | 3/1995 | McClung et al. . | |
| 5,466,060 | | 11/1995 | Hoffman . | |
| 5,520,451 | | 5/1996 | Oshima . | |
| 5,564,807 | | 10/1996 | Rock et al. . | |
| 5,645,333 | | 7/1997 | Sakurai . | |
| 5,746,490 | | 5/1998 | Domenig . | |
| 5,758,937 | | 6/1998 | Lammens et al. . | |
| 5,775,786 | | 7/1998 | Liebertz . | |
| 5,785,401 | | 7/1998 | Bowyer et al. . | |
| 5,833,337 | * | 11/1998 | Kofstad | 312/334.4 X |
| 5,842,759 | | 12/1998 | Ferrari et al. . | |
| 6,070,957 | * | 6/2000 | Zachrai | 312/334.4 |

* cited by examiner

*Primary Examiner*—Peter M. Cuomo
*Assistant Examiner*—Michael J. Fisher
(74) *Attorney, Agent, or Firm*—Boyle, Fredrickson, Newholm, Stein & Gratz, SC

(57) ABSTRACT

A mounting bracket system is provided for installing a shelving accessory within a cabinet assembly having a pair of front and rear corner posts on opposed sides of the cabinet. Each of the pair of corner posts has facing surfaces formed with aligned keyholes therein. The mounting bracket system includes a pair of mounting brackets disposed on each side of the cabinet, one of the mounting brackets being selectively mounted to a front corner post and the other being selectively mounted to a rear corner post. Each of the mounting brackets has a planar side wall including mounting structure for mounting the shelving accessory. A first end wall extends generally perpendicular to the side wall and has an outer surface engageable with one of the facing surfaces. A second end wall is spaced from and lies parallel to the first end wall. A pair of rivets is fixed to the first end wall and is spaced apart a predetermined distance matching the spacing between two of the keyholes. Each of the rivets has a head and neck structure projecting from the outer surface of the end wall. The head and neck structure is received in an upper portion of the keyhole and is slidable into a lower portion of the keyhole. A spring-biased locking device is secured to an inner surface of the first end wall and has a member protruding therethrough for releasable engagement within a keyhole. The locking device is located between the rivets for preventing dislodging of the mounting bracket relative to its respective corner post.

16 Claims, 4 Drawing Sheets

22
138
142
76
74
96
152
78
150
135
133
144
140
100
148
146
154
136
134
90
84'
34
30
38
36
52
50
48
56
54
46
40
72
80
74
102
110
120
96
112
90
108
100
106
104
98
82
84
104
98
100
126
102
90
122
96
74
70
80

SHELVING ACCESSORY MOUNTING SYSTEM FOR A CABINET ASSEMBLY

BACKGROUND AND SUMMARY OF THE INVENTION

This invention pertains to a mounting bracket system for installing a shelving accessory, such as a drawer or a flipper door, in a cabinet assembly.

Many storage cabinets and shelf frameworks include a rectangular frame structure having a pair of front corner posts and a pair of rear corner posts. Each corner post is typically formed with a surface having vertical rows of equally spaced, attachment openings for attaching shelves at various elevations. The posts are also designed to support a shelving accessory, such as a drawer or flipper door, which is typically secured by a slide mechanism or other support member to a pair of mounting bracket structures interconnected to the corner posts using the attachment openings. Each mounting bracket structure extends the full depth of the cabinet between the front and rear corner posts on one side of the cabinet.

The provision of such mounting bracket structure is intended to permit not only a simple initial installation, but also a relatively easy and quick conversion of one shelving accessory for another without dismantling the file cabinet. For example, it is desirable to be able to easily install or convert drawer and door sizes and types within a single file cabinet. While the known prior art aims for this objective, the desired installation or conversion is complicated by difficulty in installing the mounting bracket structure due to the fact that its length is greater than the front-to-rear spacing between the corner posts. Further, because prior art mounting brackets extend the full depth of the cabinet between corner posts, such brackets require a significant amount of material to manufacture, and also require a certain bracket length for each cabinet depth.

Accordingly, it remains desirable to provide a mounting bracket system which will effectively adapt various shelving accessories within a file cabinet with a minimum of parts and effort. It is also desirable to provide a shelf accessory conversion system which does not require connectors such as bolts and nuts for installation. It is further desirable to provide a shelf accessory support device which is positively locked in place in one installed location and is easily released for rapid movement to another installed location.

It is an object of the present invention to provide a mounting bracket system which will permit the use of different shelving accessories within a storage cabinet. It is also an object of the present invention to provide a mounting bracket system which can easily be adapted to the spacing of attachment openings formed on the corner posts in a storage cabinet. It is a further object of the present invention to provide a shelf accessory mounting bracket which can be readily installed on the corner structure of a cabinet without the use of bolts, nuts and special tools. Another object of the present invention is to provide a shelf accessory mounting bracket which can be easily repositioned following initial installation. Yet another object of the present invention is to provide a drawer and flipper door mounting bracket system in which the same components can be used for cabinets having varying depths, and which can be readily installed by a relatively unskilled person using hand force. Still a further object of the present invention is to provide a cabinet mounting bracket system which is relatively simple in design and construction, yet extremely sturdy and reliable even under varying load.

In one aspect of the invention, a mounting bracket system is provided for use in installing a shelving accessory within a cabinet having interior corner structure provided with a vertical row of spaced apart openings. The mounting bracket system includes a pair of separate mounting brackets, each of which is adapted for connection to one of the interior corner structures. Each mounting bracket includes a planar side wall adapted to be releasably connected to the shelving accessory, and an end wall lying substantially perpendicular to the side wall and provided with self-contained, fixed fastener structure which is constructed and arranged for immediate matching alignment with the openings and for selective sliding and locking engagement with the walls forming the openings. The fastener structure includes a pair of spaced rivets projecting from an outer surface of the end wall. The end wall is formed with a hole lying between the pair of spaced rivets. The fastener structure further includes a spring-biased locking device having a member projecting through the hole. The locking device is positioned on an inner surface of the end wall and, in one embodiment, is comprised of a plate spring anchored to one of the rivets. In another embodiment, the locking device is comprised of a retractable spring-loaded pin arrangement having an end extending through the side wall. The end wall is formed with a sight hole for observing the positioning of the fastener structure relative to the openings on the interior corner structure. A second end wall spaced from and parallel to the first-mentioned end wall lies perpendicular to the side wall. The second end wall is provided with an opening or window through which the locking device is accessed. A reinforcing intermediate wall lies perpendicular to the side wall between the first-mentioned end wall and the second end wall. The side wall includes structure for fastening a drawer interlock mechanism thereto. The side wall is also provided with window through which the locking device is accessed. The shelf accessory may be either a slide mechanism operably connected to a drawer, or a receding door movable between a vertical, operative position and a horizontal, stored position.

In another aspect of the invention, a mounting bracket is provided for installing a shelving accessory within a cabinet having a pair of front and rear corner posts on opposed sides of the cabinet. Each of the pair of corner posts has facing surfaces formed with aligned openings, which may be in the form of keyholes. The mounting bracket system includes a pair of separate mounting brackets disposed one on each side of the cabinet. One of the mounting brackets is selectively mounted on a front corner post and the other mounting bracket is selectively mounted on a rear corner post. Each of the mounting brackets has a planar side wall operably connectable to the shelving accessory. A first end wall extends generally perpendicular to the side wall and has an outer surface engageable with a facing surface of one of the corner posts. A second end wall is spaced from and lies parallel to the first end wall. A pair of rivets is fixed to the first end wall and are spaced apart a predetermined distance matching the spacing between two of the keyholes. Each of the rivets has a head and neck structure projecting from the outer surface of the end wall, and the head and neck structure is received in an upper portion of the keyhole and slidable into a lower portion of the keyhole. A spring-biased locking device is secured to an inner surface of the first end wall and has a member protruding therethrough and located between the rivets for preventing dislodging of the mounting bracket relative to its respective corner post.

The invention further contemplates a method for installing a mounting bracket system used to support a shelving accessory within a cabinet having, on opposed sides thereof, front and rear corner structure defining facing surfaces, each of which has a vertical row of spaced openings. The method comprises the steps of providing a pair of mounting brackets on each side of the cabinet, one of the mounting brackets being adapted for engagement with a front corner structure and the other of the mounting brackets being adapted for engagement with a rear corner structure. Each of the mounting brackets has a side wall adapted to be releasably secured to the shelving accessory, and an end wall lying substantially perpendicular to the side wall. The end wall is provided with a pair of rivets projecting outwardly therefrom and a spring-biased locking device has a member projecting through the end wall. The rivets and locking device are adapted to be positioned in matching alignment with at least two of the openings. The method further includes applying a lateral force to each of the mounting brackets so as to engage its end wall against one of the facing surfaces and move each of the rivets into an upper portion of an opening, and applying a vertical force to the mounting bracket so as to slide each of the rivets into a lower portion of the opening and cause engagement of the locking device member within an opening, to separately engage each mounting bracket with the front and rear corner structures. The method further includes fixing the shelving accessory to the side wall of each of the mounting brackets, and to the side walls of each of a pair of mounting brackets similarly installed on front and rear corner structure on the opposite side of the cabinet.

The invention also contemplates one of the mounting bracket and the interior corner structure being provided with a rivet arrangement constructed and prearranged for immediate matching alignment and suspended engagement with attachment openings in the other of the mounting bracket and the interior corner structure.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
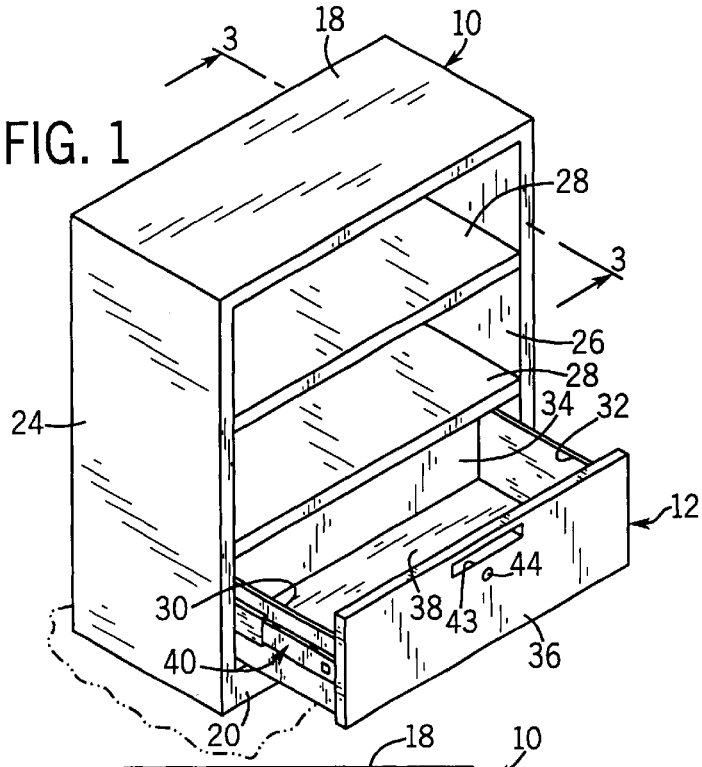
FIG. 1 is an isometric view of a cabinet assembly incorporating the shelf accessory mounting bracket system of the present invention.
Figure 3:
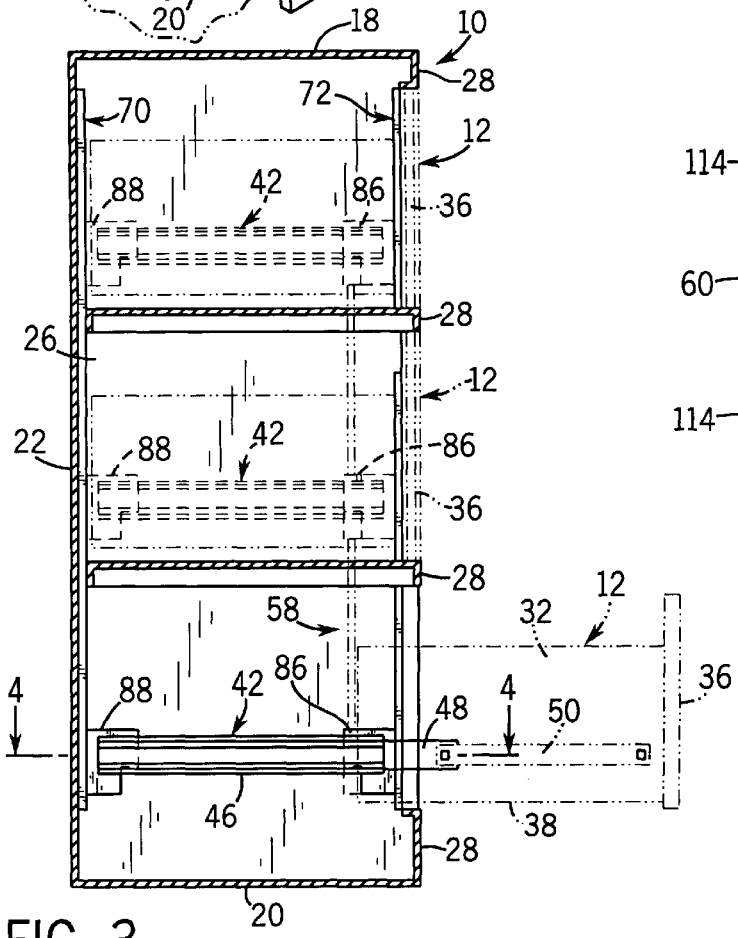
FIG. 3 is a partial, sectional view taken on line 3—3 of FIG. 1.
Figures 2, 10:
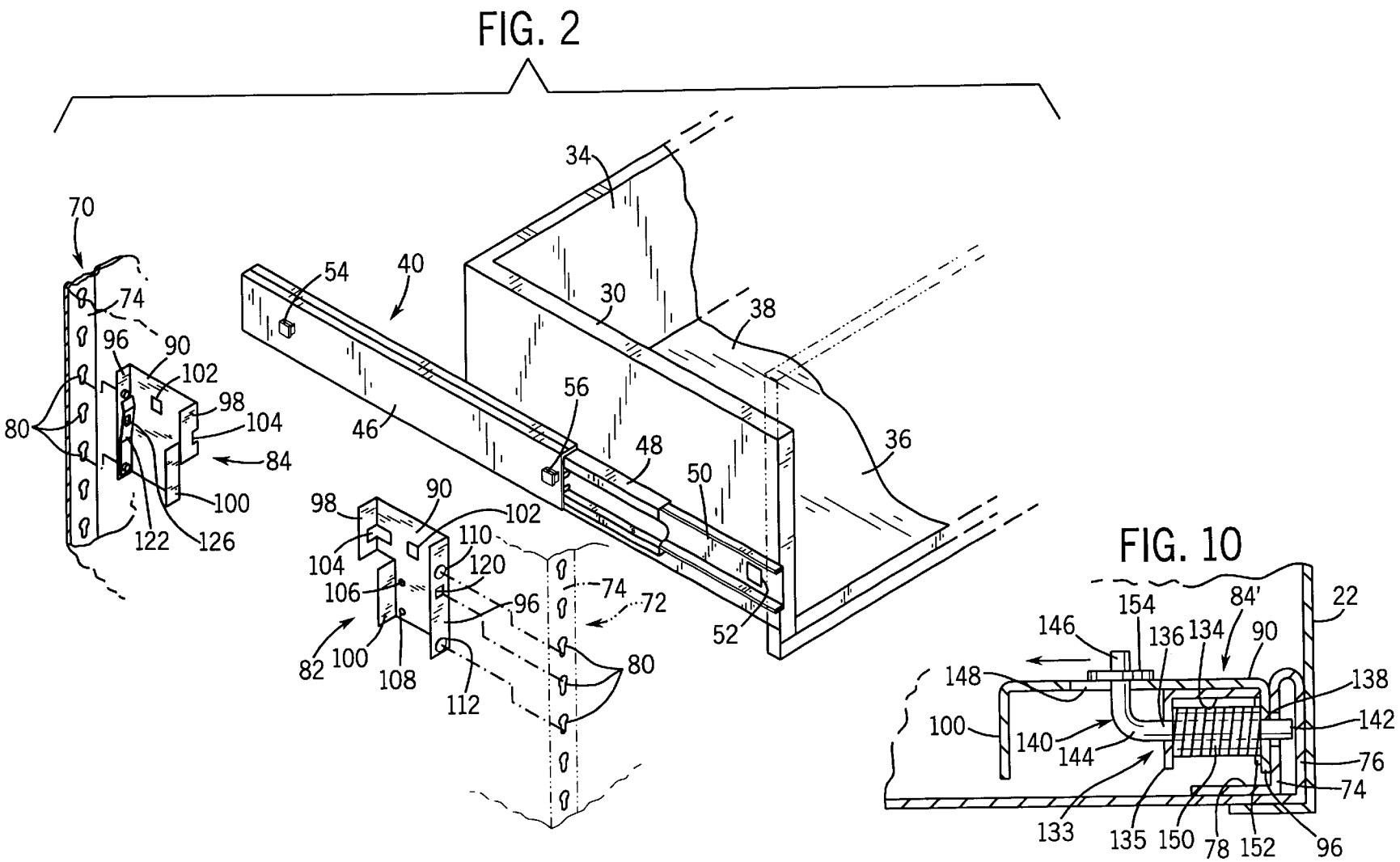
FIG. 2 is a partial, exploded view of the mounting bracket system incorporated in FIG. 1.
FIG. 10 is a partial, sectional view taken on line 10—10 of FIG. 9.

Referring to FIGS. 1–3, a cabinet assembly 10, which includes a drawer assembly 12, is formed of an upper wall 18, a lower wall 20, a rear wall 22, and a pair of side walls 24,26. The front face of cabinet assembly 10 is open, and a series of shelves 28 are mounted within the open interior of cabinet assembly 10. The general construction of cabinet assembly 10, other than the manner of mounting drawer assembly 12, is conventional and known to those skilled in the art.

Drawer 12 is of conventional construction, and is formed with an open top and interior defined by a pair of lateral walls 30,32, a back wall 34, a front panel 36, and a bottom wall 38. A pair of drawer slides 40,42 are interposed between cabinet side walls 24,26 and drawer lateral walls 30,32 in a manner to be explained, for providing sliding movement of drawer 12 between an open position and a closed position. In FIG. 1, drawer 12 is shown in its open position. The outer surface of front panel 36 is provided with a handle 43 for gripping drawer 12 to effect sliding movement thereof, and also includes a conventional locking mechanism 44 for maintaining drawer 12 in its closed position.

Drawer slide 40 is mounted to the exterior of drawer side wall 30 and drawer slide 42 is mounted to the exterior of opposite drawer side wall 32, in a manner as is known. Each slide 40,42 is a telescopic assembly comprised of three longitudinally elongate rails supported for relative translational movement. As exemplified in FIG. 2, each slide 40,42 includes an outer rail 46, an intermediate rail 48 and an inner rail 50. As is well known, these rails 46,48,50 are designed to accommodate roller or bearing elements therebetween, so that inner rail 50 moves longitudinally with respect to intermediate rail 48 on one set of bearing elements, and intermediate rail 48 moves longitudinally with respect to outer rail 46 on another set of bearing elements. An inner surface of inner rail 50 carries suitable retainer structure on a rearward end thereof and on a forward end (at 52) so as to quickly and removably secure the inner rail 50 to the exterior of drawer side wall 30. Such retainer structure is preferably a hook-and-eye type connection enabling intermediate rail 48 and inner rail 50 to extend forwardly as drawer 12 is pulled outwardly. An outer surface of the outer rail 46 includes a laterally extending hook 54 on its rearward end, and a downwardly extending hook 56 on its forward end. As will be explained below, hooks 54,56 are received in a mounting bracket system which secures the drawer slides 40,42 and drawer 12 to the cabinet framework.

To provide structural rigidity and facilitate mounting of shelves 28 and shelving accessories such as drawer 12, cabinet assembly 10 is provided on each side with a rear vertical post 70 located in the rear corner, and a front vertical post 72 positioned in the front corner. Each of the vertical posts 70,72 has an identical mirror image structure and includes an outer wall 74, an inner wall 76 folded or bent over the outer wall 74, and side walls 78 which extend perpendicularly from the ends of outer and inner walls 74, 76, respectively. At the rear corner of the cabinet 10, the inner wall 76 of rear vertical post 70 is fixedly secured to the end of cabinet rear wall 22. Cabinet side wall 26 is secured at its front and rear edges between post side walls 78. The respective inner walls 76 of the rear and front vertical posts 70,72 face each other and are provided with a series of openings in the form of keyholes 80 (FIGS. 2,6) which are equally spaced apart in a vertical row along the length of the respective posts 70,72. Keyholes 80 on the rear and front posts 70,72 are positioned and aligned at the same height in the cabinet 10, that is, the keyholes 80 are located in common horizontal planes so as to ensure a desired horizontal mounting of drawers such as 12 and shelves such as 28 within the file cabinet assembly 10.

Figures 4, 5, 7, 9:
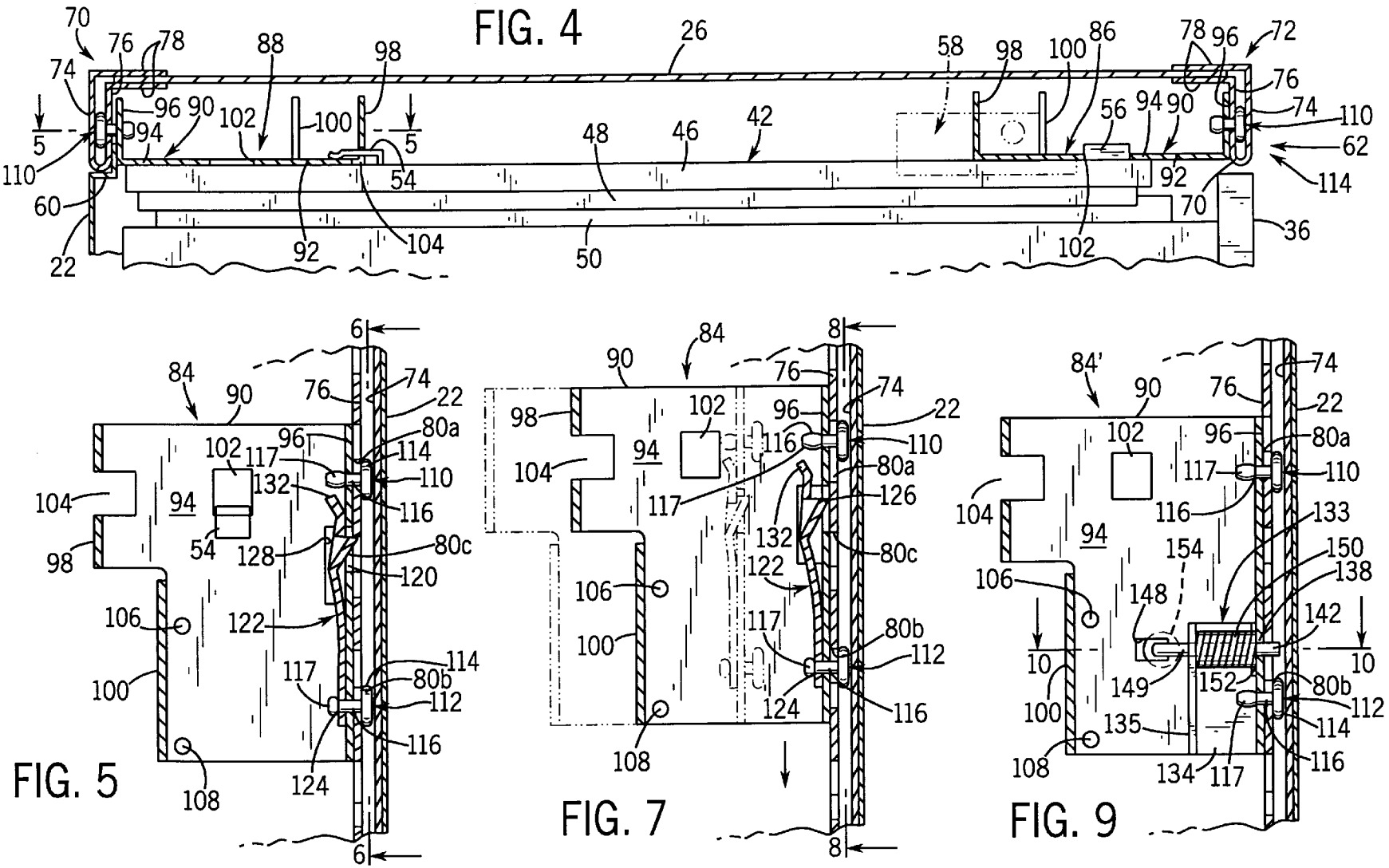
FIG. 4 is a partial, sectional view taken on line 4—4 of FIG. 3
FIG. 5 is a partial, sectional view taken on line 5—5 of FIG. 4, showing a mounting bracket in an installed condition relative to the file cabinet assembly.
FIG. 7 is a partial, sectional view similar to FIG. 5, showing the mounting bracket in a partially installed condition.
FIG. 9 is a first alternative embodiment of a mounting bracket for use in the cabinet assembly.

In accordance with the invention, a set of mounting brackets are employed to install a shelving accessory, such as a drawer, for sliding movement within the file cabinet assembly. FIG. 2 depicts a first pair of mirror image front and rear mounting brackets 82,84, respectively, which are attached between the cabinet corner structure and slide 40 on the left side of the cabinet. FIGS. 3 and 4 illustrate a second pair of mirror image front and rear mounting brackets 86,88, respectively, which are joined between the cabinet corner structure and slide 42 on the right side of the cabinet.

In the preferred embodiment, each mounting bracket 82–88 is constructed of a unitary piece of rigid metal material, such as steel, which is typically bent and punched into a desired configuration. Mounting bracket 84 will be described in detail with reference to FIGS. 2 and 5, and it is understood that this description applies equally to mounting brackets 82,86 and 88.

Mounting bracket 84 is formed with a planar side wall 90 having a front surface 92 (FIG. 4) adapted to lie flush against slide 42, and a rear surface 94 (FIGS. 4,5) adapted to lie parallel to cabinet side wall 26. A first end wall 96 projects from rear surface 94 and is bent at substantially a right angle along the entire length of the side wall 90. A second end wall 98 also extending from rear surface 94 is bent parallel to first end wall 96 and lies coextensive with an upper portion of first end wall 96. Both end walls 96,98 are formed with substantially the same depth as measured from the side wall 90. Each mounting bracket rear surface 94 also includes an intermediate wall 100 which lies offset from second end wall 98. Intermediate wall 100 is bent between and parallel with the first and second end walls 96,98 and is coextensive with the lower portion of the first end wall 96. As seen in FIG. 4, the intermediate wall 100 has a depth which is equal to that of the first and second end walls 96,98 and functions to reinforce and strengthen mounting bracket 84.

Side wall 90 of each mounting bracket is formed with an opening 102. With respect to front mounting brackets 82,86, opening 102 receives the downwardly extending hook 56 projecting from the forward end of the outer surface of each slide outer rail 46. With respect to rear mounting brackets 84,88, opening 102 performs no function. Side wall 90 and end wall 98 are provided with a corner opening 104. In addition, side wall 90 of each mounting bracket is provided adjacent intermediate wall 100 with a pair of small apertures 106,108, the purpose of which will later be explained.

First end wall 96 of each mounting bracket is provided with an upper rivet 110 and a lower rivet 112 spaced therefrom a predetermined distance matching the spacing of a pair of keyholes **80*a*,80*b* (FIGS. 5 and 6) on corner inner walls 76. Each upper rivet 110 and each lower rivet 112 has a cylindrical head 114 which is sized so as to pass through an upper circular portion of keyhole 80. Also, each rivet 110,112 has a cylindrical neck 116 of smaller diameter than the head 114 which slides along the edges on a lower portion of each keyhole 80*a*,80*b* and rests at the bottom thereof so as to suspend and retain each mounting bracket 82–88 relative to a respective cabinet corner post 70,72. In addition, each rivet 110,112 has an inner end 117 enlarged with respect to its neck 116 and fixedly joined to end wall 96. Together the rivets 110,112 define a self-contained, fixed fastener structure constructed and arranged for immediate matching alignment with keyhole 80 and for sliding and locking engagement with the walls forming keyholes 80**.

First end wall 96 of each mounting bracket is punched or otherwise formed with a rectangular hole 120 lying between upper and lower rivets 110,112. Like rivets 110,112, hole 120 is located at a position aligned with respective keyholes 80 formed in vertical posts 70,72. The function of hole 120 will become understood with the description to follow.

First end wall 96 of each mounting bracket is also provided on its inner surface with a spring-biased locking device in the form of an elongated, plate-type spring 122 having a bottom end 124 which is anchored to each lower rivet 112. The upper portion of spring 122 is suitably formed so that it will normally exert a force against the inner surface of first end wall 96. As seen best in FIGS. 5 and 6, when rear mounting bracket 84 is in its installed position, the plate-type spring 122 has a protrusion 126 which is biased so as to project though second hole 120 on first end wall 96 and lockingly engage the walls of keyhole **80*c* on the respective vertical posts 70,72. Side wall 90 of each mounting bracket is formed with an opening 128 which permits access to spring 122** on the installed mounting bracket, as will be further appreciated hereafter.

Figure 6:
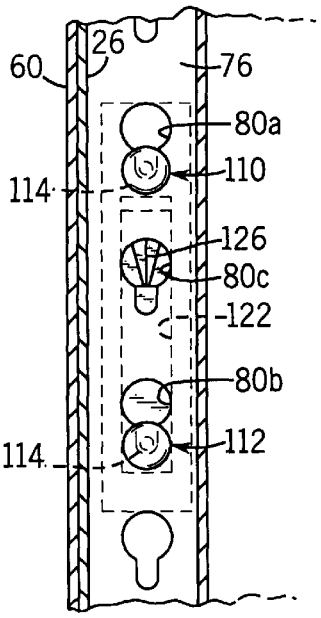
FIG. 6 is a partial, sectional view taken on line 6—6 of FIG. 5.
Figure 8:
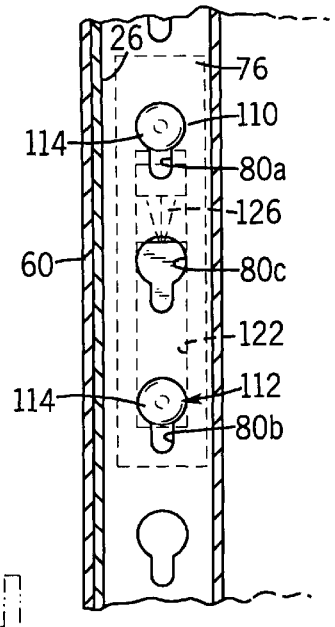
FIG. 8 is a partial, sectional view taken on line 8—8 of FIG. 7.

FIGS. 7 and 8 illustrate the manner in which rear mounting bracket 84 is installed on rear vertical post 70 on the right side of the cabinet 10. With the rear surface 94 of bracket side wall 90 facing towards the cabinet side wall 26, and an outer surface of first end wall 96 positioned adjacent vertical post 70, mounting bracket 84 is progressively moved laterally (i.e. rightward) from the phantom line position in FIG. 7 to the solid line position. During initial movement, the heads 114 of upper and lower rivets 110,112 are passed through the upper circular portions of a desired spaced pair of keyhole openings **80*a*,80*b*. The spacing between the respective back and front surfaces 74,76 of vertical post 70 through which the rivet heads 114 travel is sized so that protrusion 126 on spring 122 is forced rearwardly against its forward bias as protrusion 126 engages front surface 76 between keyholes 80*a*,80*b*. At this point, mounting bracket 84 is moved downwardly in the direction of the arrow in FIG. 7, so that necks 116 of rivets 110,112 will engage the bottom of the slotted lower portion of keyholes 80*a*,80*b* and enable mounting bracket 84 to be suspended from its corner post 70. During this latter movement, protrusion 126 of spring 122 will slide downwardly along front surface 76 and be forced by spring 122 into locking engagement with the walls of keyhole 80*c*, as depicted in FIG. 6. In its installed position of FIGS. 5 and 6, mounting bracket 84 is positively secured by engagement of spring protrusion 126 with the upper edge of keyhole 80*c*, such that any upward force on mounting bracket 84 will not move mounting bracket 84** away from its installed position.

Front mounting bracket 82 is similarly installed to front vertical post 72 at a height corresponding to that of rear mounting bracket 84. Next, the front and rear mounting brackets 86,88, respectively, on the other side wall 24 of the cabinet are installed again at the chosen height of the first installed mounting bracket 84. With both pairs of front and rear mounting brackets 82–88 installed, each slide 40,42 is attached via the retainer structure previously described. That is, the hooks 54,56 on each slide 40,42 are aligned with their respective openings 102,104 after which each slide is moved first rearwardly to engage hook 54 with opening 104 and then downwardly to engage hook 56 with opening 102. With both slides 40,42 in position, the side walls 30,32 of drawer 12 can be secured to respective inner rails 50. The above installation steps are repeated for any additional drawers to be installed on cabinet assembly 10.

Any number of additional sets of mounting brackets 82–88 may be installed on cabinet assembly 10 to accommodate additional drawers 12, as shown in phantom in FIG. 3. In such a multi-drawer installation, the components of an interlock mechanism 58 are mounted to and between one set of the vertically aligned front mounting brackets such as 82. Interlock mechanism 58 prevents more than one of the drawers 12 from being open at one time in order to prevent tipping of the cabinet assembly. Interlock mechanism 58 is of the type disclosed in U.S. Pat. No. 5,333,949 issued Aug. 2, 1994 to McGregor, and commonly assigned to the assignee of this application, the disclosure of which patent is herein incorporated by reference. With all mounting brackets 82–88 in place, interlock mechanism 58 is installed on one side of the cabinet using the two small holes 106,108 on each front mounting bracket 82.

It can be seen from FIG. 3, that in their installed condition, the bottoms of mounting brackets 82–88 generally define the height or horizontal plane at which the drawers 12 slide. In addition, as represented in FIG. 4, front surfaces 92 of each installed mounting bracket 88,86 engage outer rail 46 of slide 42 with the rear surfaces 94 of mounting brackets 88,86 and the outer rail 46 lying substantially parallel to cabinet side wall 26. A similar relationship exists with respect to installed mounting brackets 82,84 and cabinet side wall 24. This alignment allows drawers 12 to slide in and out without any binding interference. The individual mounting brackets 82–88 are extremely strong owing to their reinforcing and intermediate walls 100 which help prevent distortion of the brackets even under varying load. Unlike prior mounting brackets which necessitate bolts and nuts, the mounting brackets 82–88 of the present invention utilize strategically spaced, permanent rivet fasteners and a spring-type retainer, which can be rapidly and reliably installed using manual force, without tools, to allow the attachment of a shelving accessory, such as a drawer, to a cabinet structure.

Just as the mounting brackets 82–88 are quickly installed, so too they may be easily demounted or "knocked down" and repositioned upon removal of drawer 12 and its associated slides 40,42 to as to establish a different drawer arrangement or attach a different type of shelving accessory to the cabinet 10. In order to accomplish removal of each bracket 82–88, an elongated tool, such as a screwdriver, is inserted through the access opening 128 on side wall 90 and levered against the spring 122 in a manner which releases protrusion 126 from engagement with the walls of its keyhole 80*c*. Then, each mounting bracket such as 84 may be pushed upwardly until the heads 114 of the rivets 110,112 are again aligned with the keyhole upper portion, after which the mounting bracket is pulled outwardly away from the respective vertical post 70,72. The mounting brackets 82–88 are then quickly repositioned using the same installation procedure as described above.

FIGS. 9 and 10 illustrate an alternative embodiment of the invention in the form of a mounting bracket 84', which is generally similar in construction to mounting brackets 82–88 as described above, and like reference characters will be used where possible to facilitate clarity. Mounting bracket 84' differs from mounting brackets 82–88 in that it includes a spring loaded pin arrangement 133 which functions in place of plate-like spring 122. In particular, the lower front surface portion of mounting bracket 84' is provided with an L-shaped plate having a back leg 134 welded to rear surface 94 and a support leg 135 formed perpendicular thereto. Leg 135 has a through hole 136 which is aligned with a similarly-sized aperture 138 on first end wall 96 of bracket 84', directly above the lower rivet 112. The pin arrangement 133 includes an L-shaped pin 140 having a first end 142 which protrudes through aperture 138, a central portion 144 which passes through hole 136 and a second end 146 which passes through a horizontal slot 148 formed in bracket side wall 90. A coil spring 150 encircles pin central portion 144, and has one end biased against support wall 135 and a second end biased against a collar 152 which is affixed to the pin first end 142 on the inside of bracket first end wall 96. In its normal condition, the coil spring 150 acts to force pin first end 142 outwardly into locking engagement with the upper portion of keyhole 80*b*, to maintain engagement of mounting bracket 84' with corner post 72. The pin second end 146 is provided with a finger button 154 which is manually activated to retract the pin 140 against the force of spring 150 during installation and removal or repositioning of mounting bracket 84'.

Figure 11:
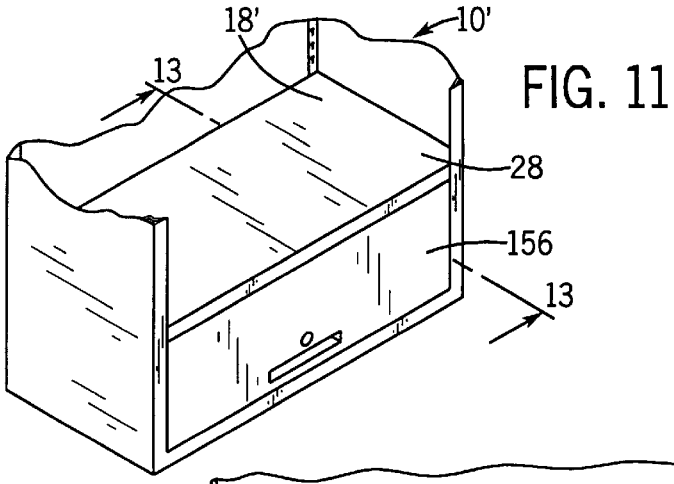
FIG. 11 is a partial isometric view of a cabinet assembly incorporating a receding flipper door mounted using the accessory mounting bracket system of the present invention.
Figure 13:
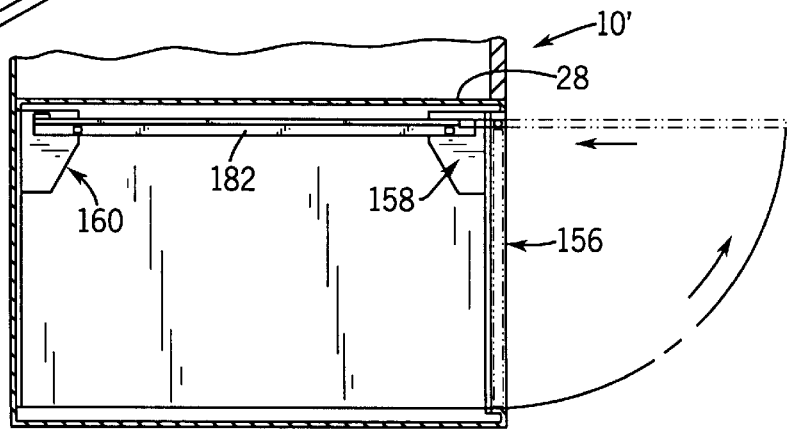
FIG. 13 is a partial, sectional view taken on line 13—13 of FIG. 11.
Figure 12:
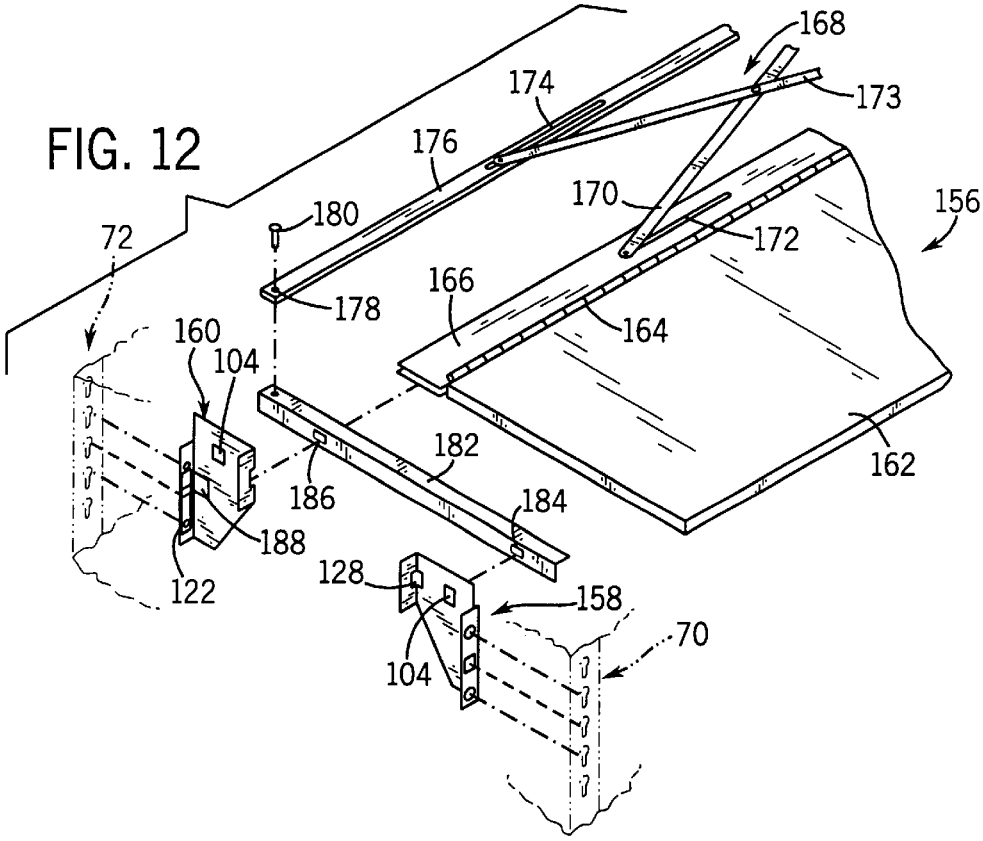
FIG. 12 is a partial, exploded view of the flipper door mounting system of FIG. 11.

FIGS. 11–13 illustrate applicability of the mounting bracket system of the invention in a cabinet assembly 10' for mounting a receding or flipper door assembly 156. In this embodiment of the invention, a set of front and rear mounting brackets 158,160 are employed on each side of the cabinet to mount flipper door assembly 156 to the cabinet assembly 10'. In this arrangement, flipper door assembly 156 has a front panel 162 pivotably connected by a hinge 164 with an internal spring mechanism to a rear portion 166. A scissors assembly 168 has a first member 170 slidably mounted in a first slot 172 formed in the rear portion 166. Scissors assembly 168 also includes a second member 173 mounted in a second slot 174 on a cross piece 176 which is fixed and extends across the width of cabinet assembly 10'. Cross piece 176 has opposed ends, one of which is shown at 178 connected by a screw 180 to the rear end of an angle bar 182 on which front panel 162 slides when it is pivoted to its horizontal position shown in FIGS. 12 and 13. It should be understood a companion angle bar 182 is provided on the other side of the flipper door assembly 156. Each angle bar 182, like slide 40,42, carries a front connector 184 and a rear connector 186 to facilitate connection to respective front and rear mounting brackets 158,160.

The components and operation of flipper door assembly 156 are conventional and known to those skilled in the art.

Mounting brackets 158,160 are generally similar in construction and operation to mounting brackets 82–88. Mounting brackets 158,160 are formed without an intermediate reinforcing wall and are appropriately shaped and sized to absorb the forces generated in the vertical and horizontal movement of the movable components of flipper door assembly 156. Mounting brackets 158,160 function similarly to mounting brackets 82–88 , and include openings 104 and 128 which receive connectors 184, 186 of angle bar 182 to mount flipper door assembly 156 to cabinet assembly 10'. Each mounting bracket 158,160 includes a plate-type spring 122 for installation as previously described above. In addition, each mounting bracket 158,160 is provided with a second access window 188 in the bracket side wall 90 adjacent first end wall 96. Access window 188 may be used in releasing the plate-type spring protrusion 126 when it is desired to remove the mounting brackets 158,160.

It should be appreciated that the present invention provides a modular mounting bracket system for conveniently and reliably installing and repositioning a shelf accessory such as a drawer or flipper door in a cabinet. The mounting bracket system of the present invention does not require the locating and joining of bolts and nuts, but instead employs a permanent riveted design which is aligned to match up with corresponding keyholes formed in a vertical corner post. The mounting bracket system of the present invention also features a biased locking device to prevent dislodging of the brackets under varying loads. The mounting bracket system of the invention enables use of the same mounting brackets for cabinets of varying depths, which greatly simplifies manufacturing and provides significant flexibility in installation. The system employs mounting brackets which are quickly and easily installed and removed without special tools.

Various alternatives and embodiments are contemplated as being within the scope of the following claims particularly pointing out and distinctly claiming the subject matter regarded as the invention. For example, the invention also contemplates a system having rivets mounted on the vertical corner structure and attachment openings spaced in matching alignment formed on the end wall of the mounting bracket. In such an arrangement, the rivets may be formed with variously shaped heads which are retained within cooperably shaped attachment openings.

We claim:

1. A mounting bracket system for installing a shelving accessory within a cabinet having a pair of front and rear corner posts on opposed sides of the cabinet, each pair of corner posts having facing surfaces formed with aligned openings therein, the mounting bracket system comprising:

a pair of separate mounting brackets engageable with the front and rear corner posts on each side of the cabinet, wherein each pair of mounting brackets includes a first mounting bracket adapted for engagement with the front corner post and a separate second mounting bracket for engagement with the rear corner post, wherein the separate first and second mounting brackets are engageable with the front and rear corner posts, respectively, independently of each other and independently of the shelving accessory;

wherein each mounting bracket includes a shelving accessory mounting arrangement engageable with the shelving accessory for mounting the shelving accessory to the mounting bracket, engagement structure engageable with at least one of the openings in the corner post for mounting the mounting bracket to the corner post, and a releasable locking member engageable with the corner post for preventing dislodging of the mounting bracket relative to the corner post.

2. The mounting bracket system of claim 1, wherein the engagement structure of each mounting bracket includes a pair of spaced projections extending from an end wall defined by the mounting bracket, wherein each projection is engageable within one of the openings in the corner post.

3. The mounting bracket system of claim 2, wherein the end wall is formed with a hole lying between the pair of spaced projections.

4. The mounting bracket system of claim 3, wherein the locking member comprises a spring-biased locking member projecting through the hole and engageable within one of the openings in the corner post.

5. The mounting bracket system of claim 4, wherein the locking member is positioned on an inner surface defined by the end wall.

6. The mounting bracket system of claim 5, wherein the locking member comprises a plate-type spring anchored to one of the projections.

7. The mounting bracket system of claim 5, wherein the locking member comprises a retractable, spring-loaded pin arrangement having an end extending through a side wall defined by the mounting bracket.

8. The mounting bracket system of claim 1, wherein at least one of the mounting brackets includes structure for fastening a drawer interlock mechanism thereto.

9. The mounting bracket system of claim 1, wherein the shelving accessory comprises a slide mechanism adapted for connection to a drawer.

10. The mounting bracket system of claim 1, wherein the shelving accessory comprises a receding door movable between a vertical, operative position and a horizontal, stored position.

11. A mounting bracket for use in installing a shelving accessory within a cabinet having interior corner structure provided with a wall defining a vertical row of spaced apart openings, the mounting bracket comprising:

a side wall including mounting structure for mounting the shelving accessory;

an end wall extending transversely to the side wall and provided with fastener structure constructed and arranged for matching alignment with the openings and for selective sliding and locking engagement with the wall adjacent the openings, wherein the fastener structure includes a pair of spaced projections extending from an outer surface of the end wall, and wherein the end wall is formed with a hole lying between the pair of spaced rivets, wherein the fastener structure further includes a spring-biased locking device having a locking member projecting through the hole; and wherein the side wall is provided with an opening through which the locking device is accessed.

12. A mounting bracket for use in installing a shelving accessory within a cabinet having interior corner structure provided with a wall defining a vertical row of spaced apart openings, the mounting bracket comprising:

a side wall including mounting structure for mounting the shelving accessory;

a first end wall extending transversely to the side wall and provided with fastener structure constructed and arranged for matching alignment with the openings and for selective sliding and locking engagement with the wall adjacent the openings;

a second end wall spaced from and parallel to the first end wall and extending transversely to the side wall; and a spring-biased locking device located within an internal space defined by the side wall and the first and second end walls.

13. A mounting bracket for use in installing a shelving accessory within a cabinet having interior corner structure provided with a wall defining a vertical row of spaced apart openings, the mounting bracket comprising:

a side wall including mounting structure for mounting the shelving accessory;

a first end wall extending transversely to the side wall and provided with fastener structure constructed and arranged for matching alignment with the openings and for selective sliding and locking engagement with the wall adjacent the openings;

a second end wall spaced from and parallel to the first end wall and extending transversely to the side wall; and a reinforcing intermediate wall oriented perpendicular to the side wall between the first end wall and the second end wall.

14. A method for installing a mounting bracket system used to support a shelving accessory within a cabinet having, on opposed sides thereof, front and rear corner structure, each having a facing surface provided with a vertical row of spaced openings, comprising the steps of:

providing a pair of separate mounting brackets for each side of the cabinet, each pair of mounting brackets including a front mounting bracket and a rear mounting bracket engageable with the front and rear corner structure, respectively, independently of each other and independently of the shelving accessory;

releasably mounting the front mounting brackets to the front corner structure on each side of the cabinet;

releasably mounting the rear mounting brackets to the rear corner structure on each side of the cabinet; and fixing the shelving accessory to the mounting brackets for installing the shelving accessory on the cabinet.

15. The method of claim 14, including the step of releasably locking the mounting brackets to the front and rear corner structure so as to allow removal and repositioning of each mounting bracket.

16. In a mounting arrangement for use in installing a shelving accessory within a cabinet having interior corner structure, the improvement comprising a pair of separate brackets engageable with the interior corner structure on each of a pair of sides defined by the cabinet, wherein the mounting brackets in each pair of mounting brackets are engageable with the cabinet corner structure independently of each other and independently of the shelving accessory, and wherein each mounting bracket includes: engagement structure for releasable engagement with the interior corner structure; a locking arrangement for releasably locking the mounting bracket to the interior corner structure; and shelving accessory mounting structure for mounting a shelving accessory to the mounting bracket and thereby to the cabinet through engagement of the mounting bracket with the interior corner structure.

* * * * *